United States Patent [19]

Saferstein et al.

[11] Patent Number: 4,502,498

[45] Date of Patent: Mar. 5, 1985

[54] PLASTIC NIT COMB

[75] Inventors: Albert Saferstein; Gilbert Spector, both of Rye Brook, N.Y.

[73] Assignee: Comb Associates, New York, N.Y.

[21] Appl. No.: 444,053

[22] Filed: Nov. 23, 1982

Related U.S. Application Data

[63] Continuation-in-part of Ser. No. 265,048, May 19, 1981, abandoned.

[51] Int. Cl.[3] ..... A45D 24/04

[52] U.S. Cl. ..... 132/137; 132/11 R

[58] Field of Search ..... 132/11 R, 160, 126, 132/137, 136, 142, DIG. 1

[56] References Cited

U.S. PATENT DOCUMENTS

| | | | |
|---|---|---|---|
| Re. 22,035 | 2/1942 | Huppert | 132/21 |
| 909,635 | 1/1909 | Moler . | |
| 1,021,071 | 11/1952 | Friedrich . | |
| 1,118,279 | 6/1928 | Campbell . | |
| 1,426,111 | 9/1920 | Sacker . | |
| 1,488,955 | 4/1924 | Trachtenberg | 132/102 |
| 1,580,365 | 4/1926 | Bechtold . | |
| 1,594,741 | 8/1926 | Lewis . | |
| 1,642,916 | 9/1927 | Anderson | 132/160 |
| 1,780,206 | 11/1930 | McKeller . | |
| 2,236,446 | 3/1941 | Pucci | 132/18 |
| 2,255,618 | 9/1941 | Huppert | 132/21 |
| 2,626,618 | 1/1953 | Collison | 132/137 X |
| 2,655,925 | 10/1953 | Ulvad | 132/137 |
| 2,808,062 | 10/1957 | Schiffman | 132/151 |
| 3,057,367 | 10/1962 | Langley | 132/161 |
| 3,107,665 | 10/1963 | Nordgren | 128/60 |
| 3,181,540 | 5/1965 | Abraham | 132/159 |
| 3,216,428 | 11/1965 | Hallnan | 132/137 X |
| 3,354,890 | 11/1967 | Collison | 132/136 |
| 3,464,427 | 9/1969 | Abraham | 132/136 |
| 4,206,771 | 6/1980 | Heinlein | 132/11 R |

FOREIGN PATENT DOCUMENTS 2405042 10/1977 France .

*Primary Examiner*—Gregory E. McNeill

*Attorney, Agent, or Firm*—Gottlieb, Rackman & Reisman

[57] ABSTRACT

A comb and a method of making a comb having a handle including two main surfaces having a common edge and a plurality of substantially parallel, spaced apart, elongated teeth extending from the main edge. Each tooth comprises identical first and second sections, each including a planar base portion. All of the first sections are aligned and all of the second sections are aligned and the planar base portions of the first and second sections of each tooth abut and are transversely offset with respect to each other by a distance less than the distance between adjacent aligned sections. In this way the resulting spacing between adjacent teeth is less than the tooth sections spacing.

11 Claims, 7 Drawing Figures

FIG. 1
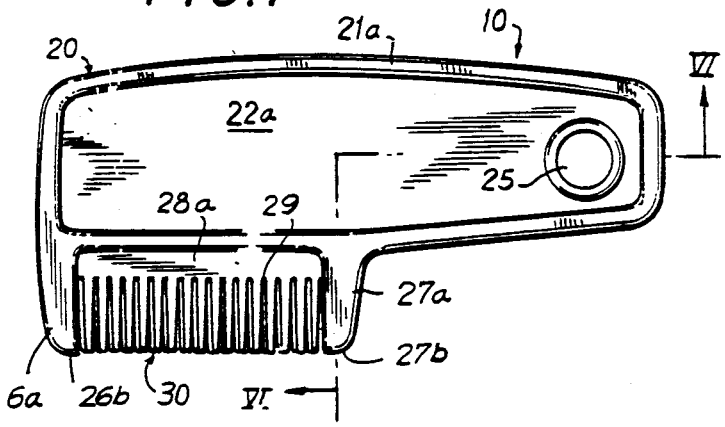
FIG. 4
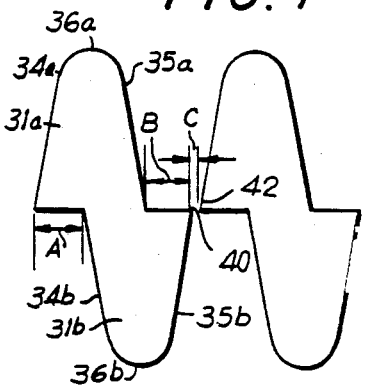
FIG. 2
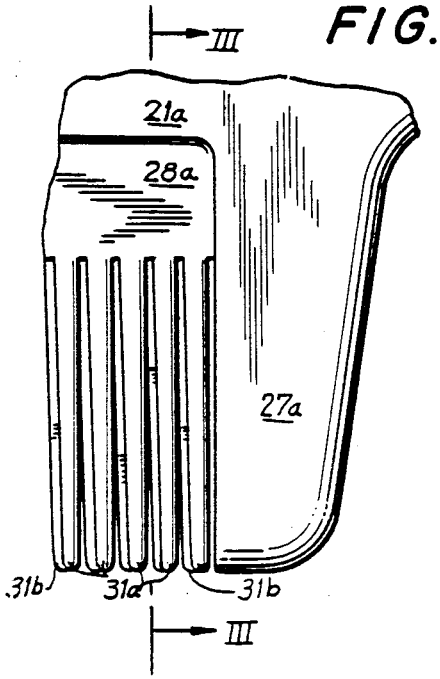
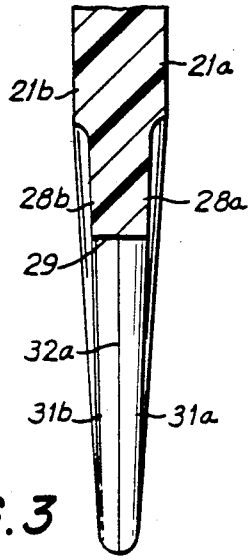
FIG. 3
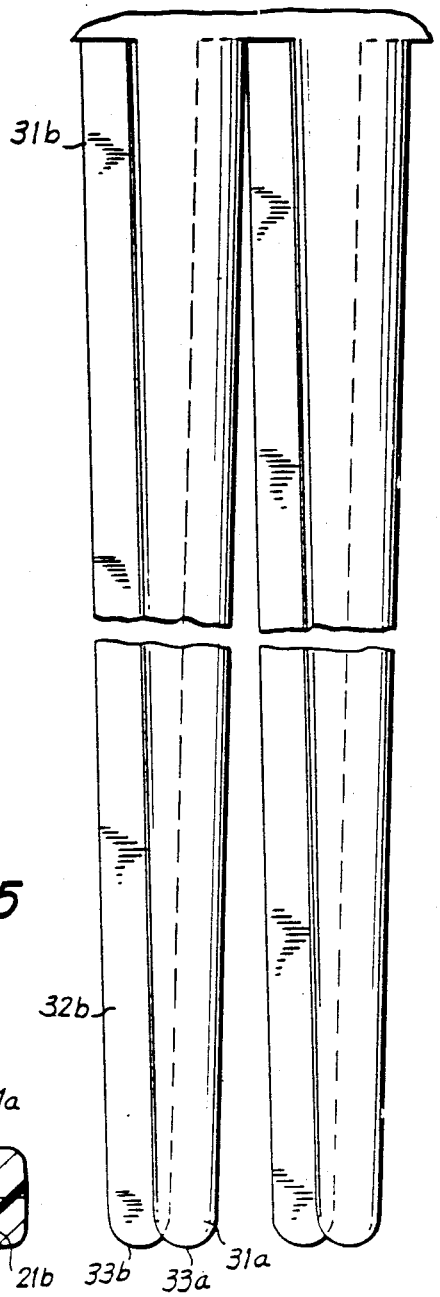
FIG. 5
FIG. 6
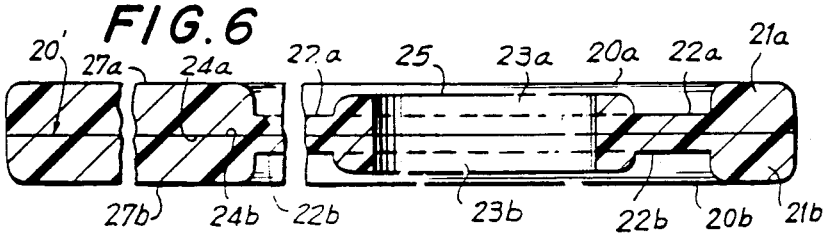

PLASTIC NIT COMB

This application is a continuation-in-part of U.S. application Ser. No. 265,048, filed May 19, 1981 now abandoned.

DESCRIPTION

1. Technical Field

The present invention relates to a comb suitable for the removal of nits, fleas and other parisites from the hair of a person or animal and a method of making the comb. More specifically the invention relates to a comb having a handle and a plurality of substantially parallel spaced apart elongated teeth extending fom an edge of the handle.

2. Background Art

Comb constructions and comb-like constructions are well known in the art as evidenced by the devices disclosed in U.S. Pat. Nos. 909,635; 1,580,365; 1,594,741; 1,642,916; 1,780,206; 2,255,618; 2,236,446; 3,057,367; 3,107,665; 3,181,540; 3,354,890 and Re 22,035.

Several of the known comb constructions employ a plurality of sets of comb teeth in fixed relationship to one another. For example U.S. Pat. No. 3,181,540 discloses a teasing comb having long pronged teeth alternating with short teeth. The short teeth allow the prongs on the ends of the long teeth to extend outwardly without contacting the short teeth. In U.S. Pat. No. 1,780,206 sets of widely spaced apart comb teeth lie in different planes so that in use a bundle of the hair is deflected in a double curve formation and flattened against the teeth. The teeth of this comb are formed by saw cuts followed by deflections of the teeth thereby providing a comb with an intertooth spacing greater than the saw blade width. In U.S. Pat. No. 3,354,890 three sets of metallic teeth are arranged in three different planes to attract and align magnetic particles that are deposited on the hair in an inert carriers. The middle set of teeth is movable with respect to the other two. Each of the combs disclosed in the aforementioned patents is designed to fashion the hair and not to separately comb individual strands such as would be necessary to remove nits from the hair. U.S. Pat. No. 3,107,665 shows a massaging device which although not strictly speaking a comb has a plurality of rows of widely separated teeth like members in different planes.

Other prior art patents disclose combs designed to be left in the hair to hold it in place or for ornamentation. For example, U.S. Pat. No. 1,580,365 employs two rows of teeth staggered with respect to each other and designed to entrap bundles of the hair between the sets of teeth. U.S. Pat. No. 1,594,741 employs two sets of teeth which are pressed together after placement in the hair to clamp the hair between them. U.S. Pat. No. 2,255,618 and U.S. Pat. No. Re. 22,035 show a comb designed to be left in the hair having a single set of teeth with oblate cross section that partially overlap to grip the hair.

Still other prior art patents disclose combs having a single set of teeth of varying configurations. U.S. Pat. Nos. 909,635 and 3,057,367 show combs with teeth having rounded or diamond shaped cross-sections to fascilitate cleaning of the comb. U.S. Pat. No. 1,642,916 shows comb teeth with a chevron shaped cross section so that adjacent teeth have a curved channel between them.

U.S. Pat. No. 2,236,446 shows a comb with widely spaced teeth having various orientations to help create a part in the hair.

None of the foregoing comb art approaches solving the problem of providing readily manufacturable combs effectively able to remove tight holding nits, fleas and other parasites from individual strands of hair.

A problem that exists in the manufacture of combs, especially those for use in the removal of nits from the hair of a person or animal, is then need to obtain close spacing of the comb teeth and at the same time ensure that a scraping action will occur on the individual hairs so as to force removal of the nits, while limiting the binding of the hair in the comb that would cause a painful pulling of the hair.

Plastic combs, while relatively inexpensive to manufacture, have the problem of not enabling the close spacing of a row of teeth due to inherent limitations in known manufacturing processes. Metal combs, although theoretically able to achieve close spacing of a row of teeth, require more expensive and complex machining.

The main object of the present invention is to provide a comb and a method of producing a comb which eliminate the disadvantages of the prior art.

Another object of the present invention is to provide a comb and a method of making the comb wherein the comb teeth are closely spaced without the need for expensive machining and which can be fabricated from plastic and which also provides the required scraping action on the hair to remove nits.

DISCLOSURE OF THE INVENTION

These and other objects of the present invention are achieved according to the present invention by a comb comprising a handle having two main surfaces having a common edge and a plurality of substantially parallel, spaced apart, elongated teeth extending from the main edge. Each tooth comprises first and second sections, each section including a planar base portion, wherein all of the first sections are aligned and all of the second sections are aligned and the planar base portions of the first and second sections of each tooth abut and are transversely offset with respect to each other by a distance less than the distance between adjacent aligned sections.

As a result, the effective distance between the teeth formed by the first and second secions is less than that of the spacing between adjacent first or adjacent second sections.

The comb according to the present invention is particularly useful with respect to the removal of nits from hair since the close spacing of the teeth separates the hair follicles and at the same time creates a tortuous path for the hair follicles and scraps the hair follicle against the offset edges of the adjacent tooth sections. This effectively removes nits that are capable of deforming and slipping through the combs of the prior art.

One method for producing such a comb according to the present invention comprises providing two comb half sections including a handle portion having a planar base and an edge and a plurality of substantially parallel spaced apart elongated tooth sections extending from the edge and each having a planar base portion in the same plane as the base of the handle portion. The two half sections are fixedly joined at the planar base portions thereof and with the tooth sections of one half section transversely offset with respect to the tooth sections of the other half section by the distance less than the distance between adjacent tooth sections on each half section. The resulting comb has the spacing between adjacent teeth being less than the spacing between adjacent tooth sections. Each of the two half sections may be formed as a single integral plastic member. The half sections may be formed from a plastic such as polyethelene, polystyrene or nylon and joined together by thermoplastic resins, adhesives or the like. The half sections can also be stamped from steel and joined by conventional metal working techniques such as soldering or welding.

A preferred method for producing the comb, according to the present invention, is to form the comb in one operation by injecting molding of a plastic material such as polyethelene, polystyrene or nylon, wherein two sections of the mold are provided, each having the negative configuration of one of the half sections previously mentioned. The two sections of the mold are brought together for the injection molding operation. During the molding operation, each mold section comprises a cavity that impresses its internal configuration upon the melted plastic which is brought into contact with the melted plastic in a cavity of the other section to form the comb. Because of the relatively large spacing between the teeth of each half section, flashover of the melted plastic material contained by each section of the injection mold is rendered unlikely. This flashover if permitted to occur would have given rise to a plastic film obstructing the operative portion of the comb, particularly at the planar base of each tooth section and the edge of the handle. The nature of the injection molding process is such that even two intricately and minutely detailed half sections do not flash over from one to the other abutting intricate half of the injection mold. Other known molding techniques such as compression molding may also be employed as an alternative to injection molding.

The comb may also be formed from various metals by employing a casting process such as dye casting using a dye formed from two sections, each having a configuration similar to that just described for the sections of the injection mold. Alternatively, each half section of the comb could be separately cast by the dye casting method and subsequently joined to form the comb.

Another feature of the invention is that the handle may have a planar portion having an aperture in which is disposed a magnifying lens of glass or plastic material. This enables one to first observe the hair before combing for nits and the like and to inspect the hair after combing to see that all the nits have been removed.

A further feature of the invention in one embodiment is that the two half sections are not adhered but at least one half section is held in contact with the other by snap means and is capable of being pivoted so that it may be separated for ease in cleaning the comb.

Other features and advantages of the present invention will become more apparent from the following detailed description of the invention along with the accompanying drawings wherein:

BRIEF DESCRIPTION OF DRAWINGS

FIG. 1 is a top plan view of the comb according to the present invention;

FIG. 2 is a blow-up of a portion of the comb of FIG. 1;

FIG. 3 is a sectional view along the line III—III of FIG. 2;

FIG. 4 is a front view of two adjacent teeth of FIG. 1;

FIG. 5 is a top view of the two teeth of FIG. 4; and

FIG. 6 is a sectional view along line VI—VI of FIG. 1.

BEST MODE FOR CARRYING OUT THE INVENTION

Figure 7:
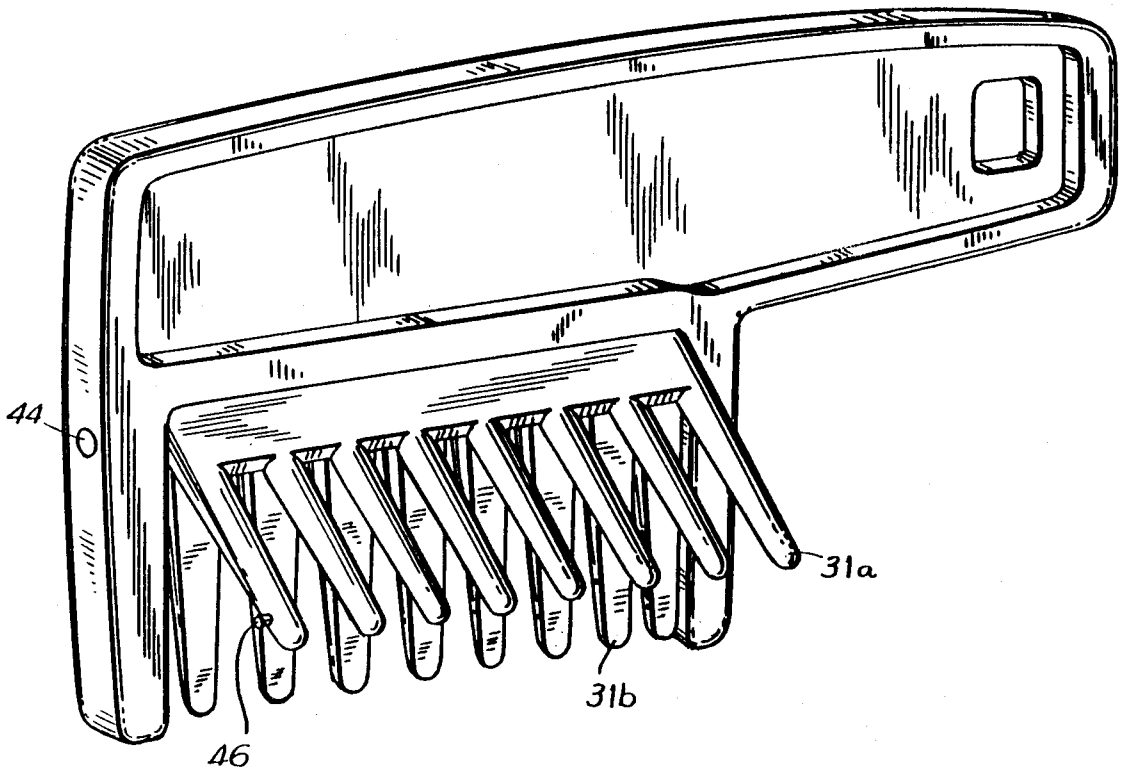
FIG. 7 is a perspective view of an alternative embodiment of the comb according to the present invention.

Referring to FIGS. 1 and 6, the comb 10 according to the present invention includes a handle 20 and a plurality of teeth 30 which will be described in more detail.

In an embodiment of the present invention, the handle 20 comprises two half sections **20*a*, 20*b* which are substantially identical and which are formed simultaneously in a single injection molding operation as a single plastic element to be the finished comb construction. The line indicated as 20' in FIG. 6 denotes an imaginary plane dividing the comb into two handle half sections 20*a*, 20*b* having opposing planar base portions 24*a*, 24*b*, respectively. Such a line may be visible as a mold mark formed in the injection molding operation. Each half section 20*a*, 20*b* includes a relatively thick peripheral portion 21*a*, 21*b* having depending tooth guards 26*a*, 26*b* (not shown) and 27*a*, 27*b* extending therefrom as shown. The handle half sections 20*a*, 20*b* also include depressed planar areas 22*a*, 22*b* having an aperture 23*a*, 23*b* receptive of a magnifying lens 25** therein to permit the visual examination of hair prior to and after combing.

Finally, as is best shown in FIG. 3, each of the half sections **20*a*, 20*b* includes a relatively thin tapering edge portion 28*a*, 28*b* terminating in an edge 29**.

Referring now to FIGS. 2–5, the teeth 30 according to the present invention are described in more detail. The teeth 30 are actually formed from tooth sections **31*a*, 31*b*, with all of sections 31*a* being borne on surface 28*a* of half section 20*a* and all of tooth sections 31*b* being borne on surface 28*b* of half section 20*b*. Each of the tooth sections 31*a*, 31*b* are identical and include a planar base portion 32*a*, 32*b* (not shown) which extends from edge 29 to end point 33*a*, 33*b*. The base portion 32*a*, 32*b* gradually taperss outwardly fom the edge 29 as shown. The tooth section also includes side surfaces 34*a*, 35*a* and 34*b*, 35*b* which extend from the edges of the base 32*a*, 32*b* and meet along an arcuate surface 36*a*, 36*b*, the height of each tooth section gradually tapering toward the outermost end thereof. While each of the tooth sections 31*a*, 31*b*** is elongated, substantially parallel and spaced apart, it is within the scope of the present invention to vary the spacing, length and parallelism of the teeth according to particular applications for the comb. For example, the teeth may be curved to form a cup like region to retain the removed nits.

The teeth sections have planar base portions **32*a*, 32*b* configured so as to be in the same plane as the planar base portions 24*a*, 24*b* of the handle half sections 20*a*, 20*b* so that the base portions 32*a*, 32*b*** of corresponding tooth sections also abut.

A key aspect of the present invention is that the tooth sections **31*a*, 31*b* are disposed on the handle half sections 20*a*, 20*b* so as to effect an offset of the tooth sections transverse to the longitudinal axis thereof, as is clearly shown in FIGS. 4 and 5. This offset A is less than the distance B between adjacent tooth sections this offset, a close spacing C of adjacent tooth sections 31*a* or adjacent tooth sections 31*b* so as to leave a portion C of the edge 29 exposed. Thus, as a result of 31***a*, 31*b* is achieved without necessitating the close spacing of the portions of the teeth within one of the tooth sections. Moreover, a particularly advantageous configuration of the tooth sections is achieved by this offsetting which enables the comb according to the present invention to be used in the application of removal of nits from hair. The spacing C of tooth sections 31*a* and 31*b* of adjacent teeth of about 0.10 mm, which is 100 microns enables a hair follicle to be separated in the space between adjacent teeth and scraped by the edge 29 and the edges of the tooth sections 31*a*, 31*b* to remove nits clinging to the hair follicle.

In a particularly advantageous commercial embodiment, the comb 10 is fabricated of a plastic material and comprises handle half sections 20*a*, 20*b* and tooth sections formed integrally on the handle half sections. The tooth sections 31*a*, 31*b* extend from the handle sections 20*a*, 20*b* 0.5" in length, 0.05" at maximum height and 0.035" in maximum width. The spacing between the centers of adjacent tooth sections is 0.054" and with an offset of 0.015", there is a resulting spacing of 0.004" between adjacent teeth. The slope of the side portions 34*a*, 34*b* and 35*b* is approximately 10 degrees. Each tooth section tapers in height from a maximum of 0.05" to 0.025" before the tip rounds off towards the planar base portion thereof. Those skilled in the art will appreciate that this embodiment provides manufacturing advantage by reason of the integral formation of the handle sections 20*a*, 20*b* and tooth sections 31*a*, 31*b*. In this embodiment there is an asymmetrical wedge shaped troth between the adjacent comb teeth which narrows as shown in FIG. 5 from the end point 33*a* to the edge portion 28*a* (shown in FIG. 1). Due to the asymmetry of the troth, two adjacent teeth as shown in FIG. 4 contact a single hair by entrapping it at a sharp-edge of one tooth and a rounded edge of the adjacent tooth, thereby reducing the tendency of the hair to bind and tear as it would if pulled against two sharp edges. This enhances the effectiveness of the comb for nit removal over that of a comb with two adjacent teeth having abutting rounded edges. To be specific, if the adjacent comb teeth shown in front section in FIG. 4 were moving upwards towards the top of the page, a hair in the gap C between the adjacent teeth would be scraped on its left side by the upward moving sharp edge 40 of tooth section 31*b* and pressed on its right side by the side portion 42 while being scraped on a third side by the edge 29 (shown in FIG. 1). Each pair of teeth has a cross-section configuration as shown in FIG. 4, that is symmetric about a point midway between the pair of adjacent teeth, and not symmetric with respect to any plane. This configuration is suprisingly efficient in the removal of nits that are capable of deforming and slipping through the space between the teeth of prior art combs. In this version, the shape of the teeth, which contributes to the advantages of the manufacturing process of this invention, co-acts with the close spacing of the teeth to increase the effectiveness of the comb for its intended purpose. When the comb is fashioned from the plastic material so that the teeth are flexible, this flexibility further contributes to the property of the comb that the hair is not pulled and torn.

One method of making the comb is simply the providing of the two comb half sections including the handle half sections 20*a*, 20*b* with integral tooth sections 31*a*, 31*b* formed thereon, and fixedly joining the two handle half sections 20*a*, 20*b* at their planar base portions 24*a*, 24*b* to effect the formation of the finished handle 20 and to effect the offsetting of the tooth sections 20*a*, 20*b* as shown. The comb half sections are formed from plastic and thereby easily molded, the two comb half sections can be fixedly joined by the use of adhesives or thermoplastic resins.

The method of making the comb 10 which is preferred is to fabricate the two comb half sections from the molten contents of an injection molding process in which the handle half sections 20*a*, 20*b* with the teeth sections 31*a*, 31*b* formed thereon are fixedly joined by molding the two handle half sections 20*a*, 20*b* at their planar base portions 24*a*, 24*b* to effect the formation of the finished handle portion 20 and to effect the offsetting of the tooth sections 31*a*, 31*b* as shown.

It is also possible to form the comb half sections out of metal such as steel by casting or stamping techniques and the two half sections can then be joined by epoxy resin, soldering or welding techniques.

In a further embodiment depicted in FIG. 7, in which the thickness of the individual teeth and the spacing between them is exaggerated, the portion 31*a* forming one of the tooth sections is pivotally mounted about pin means 44 so as to be brought together with the other tooth section 31*b* where it is held by a friction means or snap means 46. With the snap means 46 engaged the configuration of the comb resembles that of FIG. 1. With the snap means open the tooth sections 31*a* and 32*b* are spaced away from each other for facility in cleaning.

It will be appreciated that the instant specification and claims are set forth by way of illustration and not limitation, and that various modifications and changes may be made without departing fom the spirit and scope of the present invention.

We claim:

1. A comb comprising: a handle having two main surfaces having a common main edge and a plurality of substantially parallel, spaced apart, elongated teeth extending from the main edge, each tooth comprising both a first and a second section each section including a planar base portion and a convex portion wherein all of the first sections are aligned and all of the second sections are aligned and the planar base portions of the first and second sections are aligned and the planar base portions of the first and second sections of each tooth abut to each other and are offset by a distance less than the distance between adjacent aligned sections, so that the teeth are not symmetrical with respect to the plane which includes the planar base portions.

2. The comb according to claim 1, wherein the amount of offset is less than half the maximum width of each section.

3. The comb according to claim 1, wherein the handle has a planar portion having an aperture therein and a magnifying lens in the aperture.

4. The comb according to claim 1, wherein the tooth sections are equally spaced apart and the distance between the edges of adjacent first and second tooth sections at the main edge is about 0.10 mm.

5. The comb according to claim 1, wherein the width of each tooth section gradually tapers toward the outermost end and the height of each tooth section tapers gradually towards the outermost end thereof.

6. The comb according to claim 1, wherein the handle comprises two half sections each comprising one main surface and an opposing planar surface and bearing an aligned set of tooth sections with the planar bases thereof in the same plane as the planar surface of the half section.

7. the comb according to claim 6, wherein each half section with the borne set of tooth sections comprises an integral plastic member.

8. The comb according to claim 7, produced by permanently affixing the two half sections together with the offset first and second tooth sections.

9. The comb according to claim 7 wherein one half section is pivotally mounted so that the abutting tooth sections may be spaced apart to facilitate cleaning of the comb.

10. A comb comprising a plurlity of substantially parallel closely spaced elongated teeth, each tooth having a sharp edge and a rounded edge and having a cross section such that the cross section of each adjacent pair of teeth is substantially symmetric about a point midway between the adjacent pair of teeth but not symmetric about any plane, whereby a hair passing between the adjacent pair of teeth is scraped on one side by the sharp edge of one tooth of the pair and pressed on an opposite side by the rounded edge of the other tooth of the pair.

11. The comb of claim 10 in which the teeth are joined to a main edge, whereby the hair passing between the adjacent pair of teeth is scraped on a third side of the hair by said main edge.

* * * * *